United States Patent [19]

Kraai et al.

[11] 4,054,170

[45] Oct. 18, 1977

[54] INGOT MOLD AND METHOD FOR POURING INGOTS

[75] Inventors: Dwight A. Kraai; Clifford R. Whiddon, both of Lower Burrell, Pa.

[73] Assignee: Allegheny Ludlum Industries, Inc., Pittsburgh, Pa.

[21] Appl. No.: 696,239

[22] Filed: June 15, 1976

[51] Int. Cl.[2] ..... B22D 7/10

[52] U.S. Cl. ..... 164/53; 164/125; 164/DIG. 6; 249/174

[58] Field of Search ..... 249/174; 164/53, 122, 164/125, DIG. 6, 123

[56] References Cited

U.S. PATENT DOCUMENTS

| | | | |
|---|---|---|---|
| 1,667,289 | 4/1928 | Gothmann | 249/174 UX |
| 1,881,088 | 10/1932 | Matuschka | 249/174 UX |
| 2,294,169 | 8/1942 | Francis et al. | 164/53 |
| 2,495,992 | 1/1950 | Urmetz | 249/174 UX |
| 2,737,696 | 3/1956 | Shields | 164/53 |
| 2,867,871 | 1/1959 | Shephard, Jr. | 164/53 |
| 3,002,238 | 10/1961 | Orrison | 164/53 X |

FOREIGN PATENT DOCUMENTS

| | | | |
|---|---|---|---|
| 642,895 | 6/1962 | Canada | 164/53 |

*Primary Examiner*—Ronald J. Shore

*Attorney, Agent, or Firm*—Vincent G. Gioia; Robert F. Dropkin

[57] ABSTRACT

An ingot mold of the bottle-top type and method for its use wherein the primary pipe or shrinkage cavity at the top of the ingot is decreased in length and a solid bridge is formed between the primary and secondary pipe cavities, sealing off the secondary cavity. The cast ingot is cropped in the area of the solid bridge between the primary and secondary pipe cavities, leaving the secondary cavity sealed such that it can be welded without oxidation during hot rolling to increase the ingot yield.

6 Claims, 6 Drawing Figures

INGOT MOLD AND METHOD FOR POURING INGOTS

BACKGROUND OF THE INVENTION

As is known, ingot molds in common use in the steel industry have a tapered inner cavity; and if the end of the cavity of largest cross-sectional area is at the bottom of the mold, it is classified as a big-end-down type of mold. As molten steel is poured into the ingot mold, the metal nearest the mold wall is cooled first to form the skin of the mold. Thereafter, as more heat is extracted from the metal, this skin grows in thickness until the entire ingot has solidified. Due to the shrinkage of the metal during solidification, a pipe or shrinkage cavity is formed at the top of the ingot; and this shrinkage cavity most be cropped off after the ingot is formed into a slab in a blooming mill and before rolling into hotband. Obviously, it is desirable to minimize the depth of the primary pipe or shrinkage cavity in order to increase the yield obtained from the ingot.

In order to minimize the length of the primary pipe and thus minimize slab crop losses, molds have been used utilizing "bottle top" configuration wherein the top end of a big-end-down mold cavity is necked down in the area where the primary pipe forms. This relocates a portion of the shrinkage cavity or pipe, decreasing the primary pipe region and creating or increasing a secondary pipe cavity which welds together during hot-working from ingot to hot-band. It is important, in cropping off the primary pipe cavity, to insure that the crop shear does not sever the secondary pipe cavity. If it is severed, air will flow into the secondary cavity and oxidize the metal with the result that scale will be included in the interior of a slab when it is rolled into strip.

SUMMARY OF THE INVENTION

In accordance with the present invention, apparatus for casting ingots and for increasing ingot yield is provided comprising an ingot mold having an interior wall defining a mold cavity provided with a necked-down bottle top portion. The bottle-top portion is of sufficient length to produce between the primary and secondary pipe cavities formed in the cast ingot a solid bridge of metal through which a crop shear can pass without severing the secondary pipe cavity.

Preferably, the steel poured into the mold is a killed steel; and the upper part of the necked-down bottle-top portion is lined with a hot top comprising sideboards having a covering of exothermic material. In order to achieve the desirable results of the invention, and assuming that a 3% silicon steel is being cast, the volume encompassed by the hot-top sideboards should be in the range of 6 to 9% of the total volume of the mold.

The above and other objects and features of the invention will become apparent from the following detailed description taken in connection with the accompanying drawings which form a part of this specification, and in which.

Figure 1:
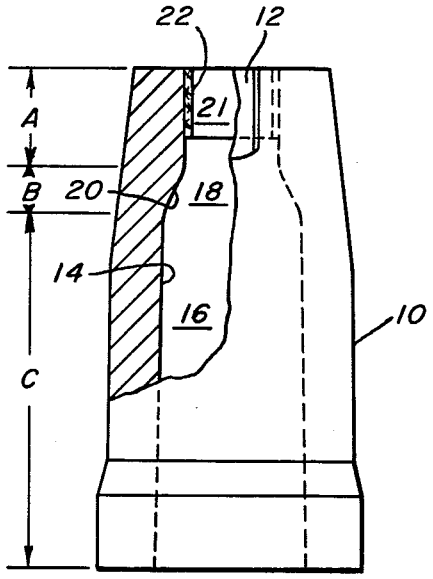
FIG. 1 is a partially broken-away plan view of the ingot mold of the invention.
Figure 2:
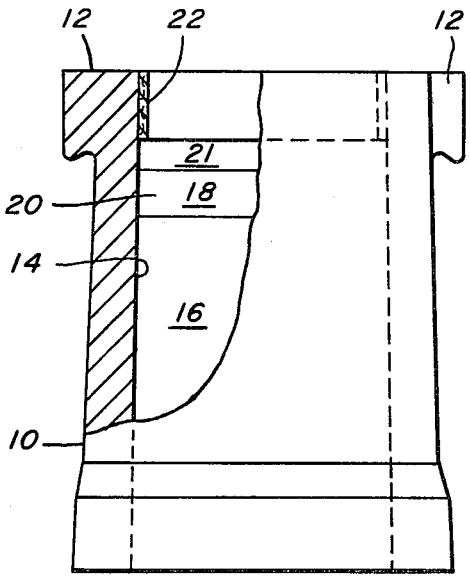
FIG. 2 is a partially broken-away side view of the ingot mold of the invention.

With reference now to the drawings, and particularly to FIGS. 1 and 2, the ingot mold shown comprises an upstanding casting 10 provided with lugs 12 adapted for engagement with an ingot stripper mechanism. The mold is of the big-end-down type and is provided with an interior mold cavity 14. The cavity 14 has a lower, tapered portion 16 which terminates at its upper end in a necked-down portion 18 having sloping side walls 20 extending along the length but not necessarily the width of the ingot cavity. Portion 18, in turn, communicates with a neck portion 21 of reduced cross-sectional area. The neck portion 21, as shown, has inserted therein a hot top 22 preferably having an exothermic substance covering its inner walls. It is important that the hot top 22 does not extend all the way down to the tapered portion 16 in order that the metal in the lower part of the neck portion will directly contact the mold side walls and rapidly chill to form a solid bridge of metal in this area.

Figures 3A, 3B, 3C, 3D:
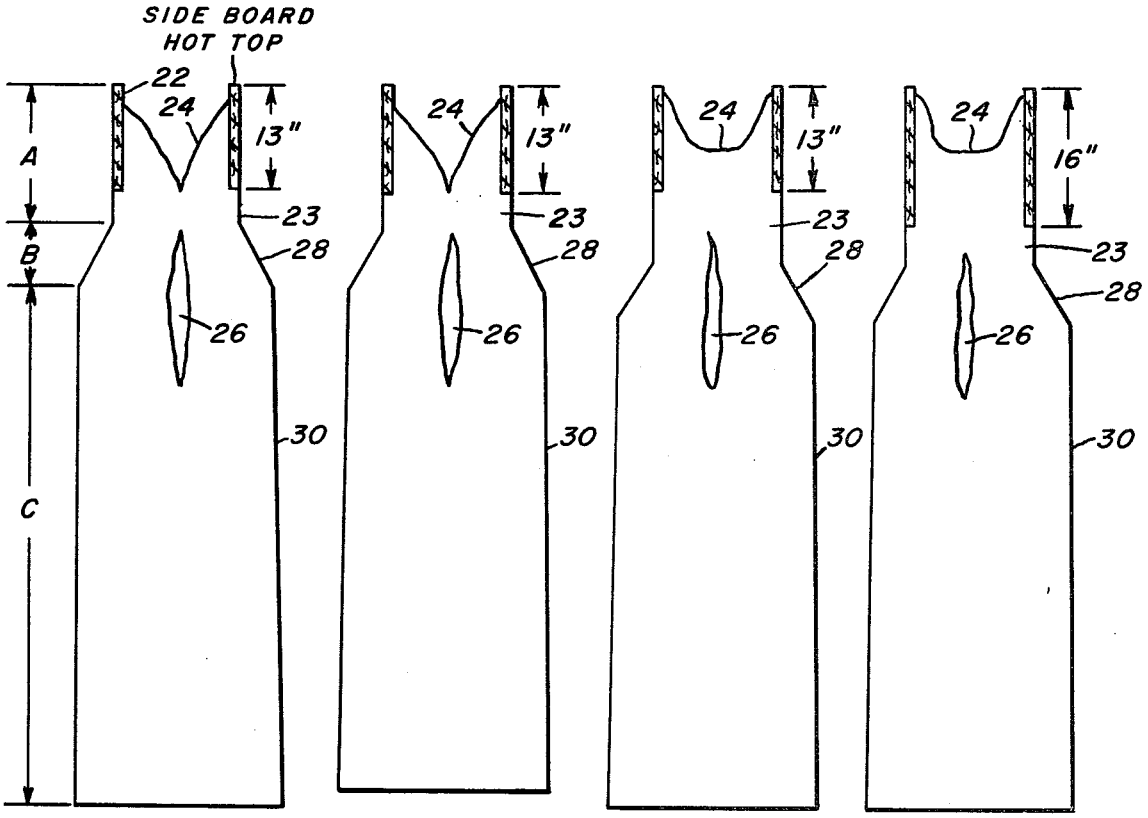
FIGS. 3A–3D are schematic illustrations showing the effect of the length of the necked-down portion of the mold on the formation of primary and secondary pipe cavities.

Cross sections of typical ingots cast in a mold of the type shown in FIGS. 1 and 2 under varying conditions are illustrated in FIGS. 3A–3D. In FIG. 3A, it will be noted that there is formed in the neck portion 23 a primary pipe cavity 24 which occurs due to shrinkage of the solidified steel. Beneath the primary pipe cavity 24 is a secondary pipe cavity 26. As was explained above, after the ingot is formed into a slab, the portion of the slab containing the primary pipe cavity 24 must be cropped off. At the same time, care must be taken not to penetrate the secondary pipe cavity 26 which is subsequently welded or squeezed together during the rolling process. Otherwise, if the secondary cavity 26 is severed, air will enter it and form an oxide scale which will be included in the final rolled product, an obviously undesirable result. It is important, therefore, to maximize the length of the solid metal bridge between the bottom of the primary pipe 24 and the top of the secondary pipe 26 since it is a matter of judgment on the part of the operator as to where the crop shear should penetrate the slab. In this respect, the dimensions A, B and C shown in FIG. 3A are critical; however, it should be understood that the length B of the tapered portion 28 is important primarily to insure that maximum yield is obtained when rolling from ingot to hot band. Dimension A is the length of the neck portion 23, and dimension C is the length of the main, tapered part 30 of the ingot. The neck portion 23 may typically have a horizontal width of about 16 inches and a horizontal length of about 43 inches. In FIG. 3A, the length A of the neck portion 23 is 17 inches; length B of the tapered portion 28 is 8 inches; and the length C is 63 inches. The depth of the hot top 22 is 13 inches. Under these circumstances, only about 3.25 inches of solid metal exist between the bottom of the primary pipe 24 and the top of the secondary pipe 26. In FIG. 3B, the design is the same as that of FIG. 3A except that the length C of the main body 30 of the ingot has been shortened to 61 inches from 63 inches. Under these conditions, the distance between the bottom of the primary pipe 24 and the top of the secondary pipe 26 is again about 3.25 inches, which is unsatisfactory.

Various hot top combinations can be used; or, in some cases, no hot top need be employed. However, a 13 inch by 1 inch thick sideboard system with an exothermic compound covering proves to be the most successful. With the designs of FIGS. 3A and 3B, pipe performance at the sheared slab face will be somewhat erratic, but yield performance is improved.

In the designs of FIGS. 3C and 3D, the length of the neck 23 (dimension A) was increased to 22 inches from 17 inches used in the designs of FIGS. 3A and 3B. In FIG. 3C, the sideboard hot top 22 again has a depth of 13 inches. This results in a distance between the bottom of the primary pipe 24 and the top of the secondary pipe 26 of 10.5 inches. Note also that the depression caused by the primary pipe cavity is much flatter, thereby increasing the distance between the two cavities. It has been found, however, that if a sideboard hot top of only 13 inches in depth is used in the design of FIG. 3C, the secondary pipe 26 may extend upwardly into the neck region 23 for a considerable distance. Therefore, it is preferable to utilize a sideboard hot top of 16 inches in depth as shown in FIG. 3D with an exothermic compound covering the inner surface of the hot top. Under these circumstances, 75% of the neck portion is covered by the hot top with the lower 25% being exposed directly to the mold side wall to promote rapid chilling in this region and the formation of a solid bridge of metal between the primary and secondary pipe cavities. This acts to push the secondary pipe 26 deeper into the ingot and eliminates the problem of the secondary pipe 26 extending into the neck region 23.

If the width of the neck portion 23 is decreased from 16 inches, which is the width in the design shown in FIGS. 3A–3D, the neck portion 23 conceivably can be reduced in height. However, this introduces problems in pouring the molten steel into the mold. It can be said, however, that when top pouring techniques are used that the length of the neck portion 23 and the depth of the hot top should be approximately equal to the width of the neck portion, which is that dimension shown in FIG. 1 of the drawings. Naturally, this would not be the case when bottom pouring techniques are employed.

Although the invention has been shown in connection with certain specific embodiments, it will be readily apparent to those skilled in the art that various changes in form and arrangement of parts may be made to suit requirements without departing from the spirit and scope of the invention.

We claim:

1. Apparatus for casting ingots comprising an ingot mold having an interior wall defining a mold cavity provided with a main bottom section, a top section of reduced cross sectional area and an intermediate tapered section connecting the top and bottom sections, and a hot top lining only a portion of the top section, said hot top terminating a substantial distance above the intermediate section and the height of the top section being such that a solid bridge of substantial height is obtained between the upper primary pipe cavity and the secondary lower cavity of the ingot.

2. The apparatus of claim 1 wherein the distance between the bottom of the hot top and the top of the intermediate section is a minimum of approximately 25% of the height of the top section.

3. The apparatus of claim 1 wherein said hot top includes an exothermic material.

4. The apparatus of claim 3 wherein the distance between the bottom of the hot top and the top of the intermediate section is a minimum of approximately 25% of the height of the top section.

5. A method of casting a steel ingot comprising the steps of providing an ingot mold having an interior wall defining a mold cavity provided with a main bottom section, a top section of reduced cross sectional area and an intermediate tapered section connecting the top and bottom sections, lining said top section with a hot top having its lower end a substantial distance above the top of the intermediate section, and pouring molten steel into said mold until the level of the molten steel reaches substantially the top of said hot top.

6. The method of claim 5 in which said hot top has a layer of exothermic material on its inner surface.

* * * * *